US011536135B2

(12) United States Patent
Al-Huwaider et al.

(10) Patent No.: US 11,536,135 B2
(45) Date of Patent: Dec. 27, 2022

(54) SYSTEMS AND METHODS FOR EVALUATING SUBTERRANEAN FORMATIONS USING AN INDUCED GAS LOGGING TOOL

(71) Applicant: Saudi Arabian Oil Company, Dhahran (SA)

(72) Inventors: Mustafa A. Al-Huwaider, Dhahran (SA); Shouxiang Mark Ma, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 40 days.

(21) Appl. No.: 17/231,551

(22) Filed: Apr. 15, 2021

(65) Prior Publication Data

US 2022/0333485 A1 Oct. 20, 2022

(51) Int. Cl.
*E21B 49/08* (2006.01)
*E21B 49/10* (2006.01)

(52) U.S. Cl.
CPC ..... *E21B 49/088* (2013.01); *E21B 49/10* (2013.01)

(58) Field of Classification Search
CPC ..... E21B 49/082; E21B 49/088; E21B 49/10
See application file for complete search history.

(56) References Cited

U.S. PATENT DOCUMENTS 3,456,504 A * 7/1969 Bombardieri ..... E21B 49/10 166/264
6,301,959 B1 10/2001 Hrametz et al.
6,745,835 B2 6/2004 Fields
7,644,610 B2 1/2010 Meister
8,593,140 B2 * 11/2013 Saldungaray ..... G01V 3/32 324/303
8,973,660 B2 * 3/2015 DiFoggio ..... E21B 49/10 166/308.1
9,303,509 B2 4/2016 Milkovisch et al.
9,416,647 B2 * 8/2016 Zuo ..... E21B 49/10
9,752,433 B2 9/2017 Proett et al.
10,626,721 B2 4/2020 Gisolf et al.
10,895,663 B2 * 1/2021 Hashem ..... E21B 43/16
2004/0104341 A1 * 6/2004 Betancourt ..... G01N 1/12 250/255

(Continued)

FOREIGN PATENT DOCUMENTS

CN 110761769 A * 2/2020
GB 2441842 A * 3/2008 ..... E21B 43/25

*Primary Examiner* — Jennifer H Gay

(74) *Attorney, Agent, or Firm* — Fish & Richardson P.C.

(57) ABSTRACT

An example logging tool includes an injection system, a detection system, and an electric control and processing system. The injection system includes a gas source, and is configured to inject a first gas from the gas source into a region of a subterranean formation. The detection system includes a gas detection chamber and one or more sensors disposed in the gas detection chamber, and is configured to receive, in the gas detection chamber, a sample from the region of the subterranean formation, and generate, using the one or more sensors, sensor measurements of the sample, The electronic control and processing system includes one or more processors, and is configured to determine one or more characteristics of the subterranean formation based on the sensor measurements.

20 Claims, 8 Drawing Sheets

(56) References Cited

U.S. PATENT DOCUMENTS

| | | | | |
|---|---|---|---|---|
| 2004/0129874 | A1* | 7/2004 | Torgersen | E21B 49/08 250/269.1 |
| 2008/0066537 | A1* | 3/2008 | Hegeman | E21B 43/25 73/152.28 |
| 2009/0151937 | A1* | 6/2009 | Goodwin | E21B 49/10 166/57 |
| 2010/0126717 | A1 | 5/2010 | Kuchuk et al. | |
| 2010/0264915 | A1* | 10/2010 | Saldungaray | E21B 43/16 324/303 |
| 2011/0198078 | A1* | 8/2011 | Harrigan | E21B 49/10 166/254.2 |
| 2011/0303409 | A1* | 12/2011 | Harrigan | E21B 49/08 166/69 |
| 2013/0037270 | A1* | 2/2013 | DiFoggio | E21B 49/10 166/305.1 |
| 2013/0197808 | A1* | 8/2013 | Zuo | E21B 47/00 702/6 |
| 2020/0379139 | A1* | 12/2020 | Hashem | E21B 49/0875 |

* cited by examiner

SYSTEMS AND METHODS FOR EVALUATING SUBTERRANEAN FORMATIONS USING AN INDUCED GAS LOGGING TOOL

TECHNICAL FIELD

The disclosure relates to systems and methods for evaluating subterranean formations using an induced gas logging tool.

BACKGROUND

A well is used to bring natural resources, such as oil or natural gas, from a subsurface formation to the surface of the earth, or injecting a fluid such as water or gas into a subsurface formation to maintain formation pressure, enhanced oil recovery, or gas storage. A well can be created and utilized according to several stages, including a drilling stage, a completion stage, and an operation stage of production or injection.

During the drilling stage, a wellbore is formed by drilling a hole through the surface of the earth and through a portion of the subterranean formation, such that the contents of the subterranean formation can be accessed. Further, the wellbore can be reinforced, for example by installing casing or pipe along its length.

During the completion stage, the well is made ready for production or injection. For example, the bottom of the wellbore can be prepared to particular specifications. As another example, production tubing and other downhole tools can be installed in or around the wellbore to facilitate the extraction of natural resources from the well.

During the operation stage, such as production, natural resources are extracted from the subterranean formation and brought to the surface of the earth. For example, oil or natural gas contained within the subterranean formation can be brought to the surface of the earth, such that they can be processed and used as sources of energy or used as a part of other industrial applications.

In some implementations, the subterranean formation can be investigated prior to, during, and/or after the performance of one or more of these stages. As an example, a subterranean formation can be investigated to determine the composition of the subterranean formation (for example, to estimate the types and amounts of natural resources that can be extracted from the subterranean formation), assess a suitability of the subterranean formation for well construction, and monitor changes of the subterranean formation over time.

SUMMARY

This disclosure describes systems and methods for evaluating subterranean formations using an induced gas logging tool. In an example implementation, an induced gas logging tool can be lowered into a borehole extending through the earth, such that it is positioned in proximity to a subterranean formation of interest. Once positioned, the induced gas logging tool injects a reactive gas (for example, oxygen gas) into the subterranean formation, and measures products of chemical reactions between the reactive gas and the contents of the subterranean formation. For example, the induced gas logging tool can measure the concentration of products of a chemical reaction between the reactive gas and hydrocarbons. These products can include carbon dioxide gas and carbon monoxide gases. As another example, the induced gas logging tool can measure the concentration of products of a chemical reaction between the reactive gas and hydrogen sulfide. These products can include sulfur dioxide gas. The composition of the subterranean formation can be estimated based on these measurements.

Further, the induced gas logging tool can include a heating system to facilitate chemical reactions between the reactive gas and formation fluids such as hydrocarbons. For example, the heating system can heat the subterranean formation to a temperature that is above an auto-ignition temperature of one or more hydrocarbons in the subterranean formation, such that the hydrocarbons ignite in the presence of the reactive gas.

The implementations described in this disclosure can provide various technical benefits. For instance, the induced gas logging tools described herein can enable the characteristics of a subterranean formation to be measured (or made measurable) more quickly, more accurately, and/or in a more environmentally safe manner, such that the processes of well construction and production are improved. As an example, gases often have a higher mobility in a subterranean formation than that of liquids. Accordingly, gas can be injected into and withdrawn from a subterranean formation more easily than liquid, thereby increasing the speed by which measurements can be performed. Further, due to the higher mobility of gases, gases can be injected deeper into a subterranean formation. Accordingly, compared to liquid samples, gaseous samples collected from a subterranean formation may be more representative of the subterranean formation as a whole.

Further, these induced gas logging tools can obtain measurements in environments in which it may be challenging for other types of logging tools to obtain useful measurements (for example, tools such as a resistivity tool and a formation testing and sampling tool). These environments can include those having low resistivity and/or low contrast pay, such as environments having thinly laminated reservoirs, fresh water environments, environments having reservoirs with high micro-porosity filled with saline water, and/or environments having tight or low permeability reservoirs from which it may be difficult to withdraw reservoir fluid samples using sampling tools. Further, these induced gas logging tools can be operated without injecting corrosive acid into the earth, which may be detrimental to the environment and may be expensive and/or time consuming to perform.

In an aspect, a logging tool includes an injection system, a detection system, and an electronic control and processing system. The injection system has a gas source, and is configured to inject a first gas from the gas source into a region of a subterranean formation. The detection system has a gas detection chamber and one or more sensors disposed in the gas detection chamber, and is configured to receive, in the gas detection chamber, a sample from the region of the subterranean formation, and generate, using the one or more sensors, sensor measurements of the sample. The electronic control and processing system has one or more processors, and is configured to determine one or more characteristics of the subterranean formation based on the sensor measurements.

Implementations of this aspect can include one or more of the following features.

In some implementations, the electronic control and processing system can be configured to determine a presence of one or more hydrocarbons in the subterranean formation based on the sensor measurements.

In some implementations, the first gas can include a chemically reactive gas.

In some implementations, the first gas can include oxygen gas.

In some implementations, the sensor measurements can indicate a concentration of each of a plurality of second gases in the sample.

In some implementations, the second gases can include at least one of carbon dioxide gas, carbon monoxide gas, oxygen gas, or sulfur dioxide gas.

In some implementations, the one or more sensors can include at least one of a carbon dioxide sensor, a carbon monoxide sensor, an oxygen sensor, a sulfur dioxide sensor, a temperature sensor or a pressure sensor.

In some implementations, the tool can also include a heating system having one or more heat sources, and can be configured to heat the region of the subterranean formation.

In some implementations, the heating system can be configured to heat the region of the subterranean formation above a first temperature. The injection system can be configured to inject the first gas from the gas source into the region of the subterranean formation while the region of the subterranean formation is above the first temperature.

In some implementations, the first temperature can be an auto-ignition temperature of one or more hydrocarbons in the region of the subterranean formation.

In some implementations, the heating source can include at least one of a microwave magnetron or an electric induction heating element.

In some implementations, the detection system can also include a pump configured to pump liquid within the gas detection chamber to an exterior of the logging tool.

In some implementations, the detection system can also include a tube configured to convey the sample from an exterior of the logging tool to the gas detection chamber. A first end of the tube can be coupled to the exterior of the logging tool. A second end of the tube can be coupled to the gas detection chamber at a location between (i) the one or more sensors and (ii) the pump.

In some implementations, the logging tool can also include a wireline configured to suspend the logging tool within a borehole extending through the subterranean formation.

In some implementations, the logging tool can also include an anchor shoe projecting from a periphery of the logging tool. The anchor shoe can be configured to align the logging tool along a central portion of the borehole.

In some implementations, the logging tool can also include an isolation packer configured to form a seal with a wall of the borehole.

In some implementations, the logging tool can be positioned on a drilling bottom hole assembly of a drilling system.

In another aspect, a method includes injecting a first gas into a region of a subterranean formation; subsequent to injecting the first gas into the region of the subterranean formation, obtaining a sample from the region of the subterranean formation; generating sensor measurements of the sample; and determining one or more characteristics of the subterranean formation based on the sensor measurements.

Implementations of this aspect can include one or more of the following features.

In some implementations, determining one or more characteristics of the subterranean formation can include determining a presence of one or more hydrocarbons in the subterranean formation based on the sensor measurements.

In some implementations, the first gas can include a chemically reactive gas.

In some implementations, the first gas can include oxygen gas.

In some implementations, the sensor measurements can indicate a concentration of each of a plurality of second gases in the sample.

In some implementations, the second gases can include at least one of carbon dioxide gas, carbon monoxide gas, oxygen gas, or sulfur dioxide gas.

In some implementations, the method can also include heating the region of the subterranean formation prior to injecting the first gas into the region of a subterranean formation.

In some implementations, heating the region of the subterranean formation can include heating the region of the subterranean formation above a first temperature. The first temperature can be an auto-ignition temperature of one or more hydrocarbons in the region of the subterranean formation.

Other implementations are directed to systems, devices, and devices for performing some or all of the method. Other implementations are directed to one or more non-transitory computer-readable media including one or more sequences of instructions which when executed by one or more processors causes the performance of some or all of the method.

The details of one or more embodiments are set forth in the accompanying drawings and the description. Other features and advantages will be apparent from the description and drawings, and from the claims.

DETAILED DESCRIPTION

Figure 1:
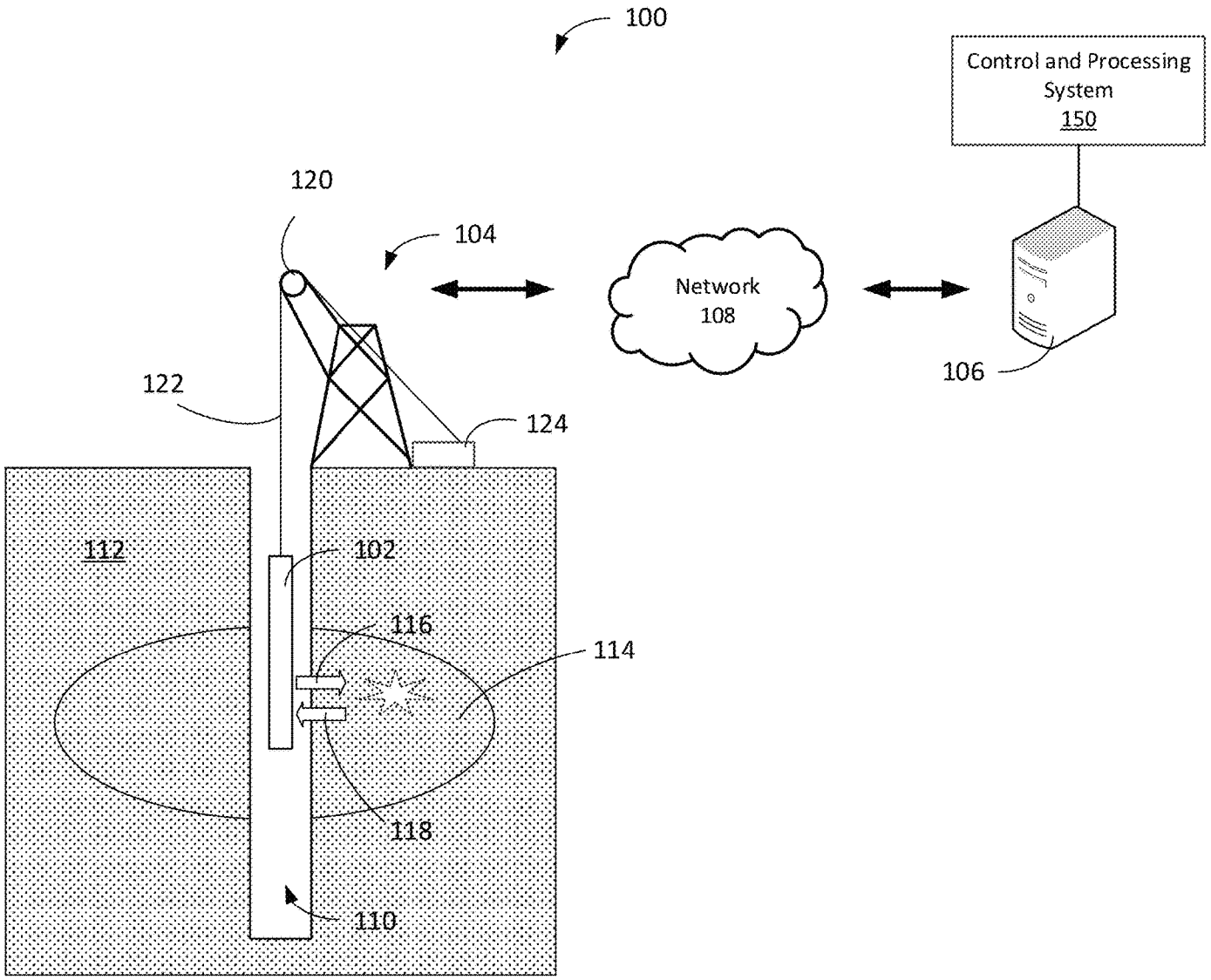
FIG. 1 is a diagram of an example system for evaluating subterranean formations.

FIG. 1 shows an example system 100 for evaluating subterranean formations. The system includes an induced gas logging tool 102, a deployment structure 104, and a computer system 106 communicatively coupled to the induced gas logging tool 102 through a network 108. Further, a control and processing system 150 is maintained on the computer system 106. The induced gas logging tool 102 is shown in greater detail in FIGS. 2A and 2B.

During an example operation of the system 100, the deployment structure 104 lowers the induced gas logging tool 102 into a borehole 110 extending through the earth 112, such that the induced gas logging tool 102 is positioned in proximity to a subterranean formation 114 of interest. As an example, the deployment structure 104 can include a crane 120 positioned above the borehole 110. Further, the induced gas logging tool 102 can include a wireline 122 that secures the induced gas logging tool 102 to the crane 120, such that the induced gas logging tool 102 is suspended above the borehole 110. Using a motor mechanism 124 (for example, a motorized winch), the deployment structure 104 can extend the wireline 122 to lower the induced gas logging tool 102 into the borehole 110. The deployment structure 104 can also adjust the position of the induced gas logging tool 102 within the borehole 110 using the motor mechanism 124, such as by extending and/or retracting the wireline 122.

In some implementations, instead of being suspended by a wireline 122, the induced gas logging tool 102 can be positioned on a portion of a drilling system, such as the bottom hole assembly. This can be beneficial, for example, as it enables the induced gas logging tool 102 to be operated during the drilling of the borehole 110 (for example, to perform logging while drilling).

In some implementations, the borehole 110 can be wellbore within which well structures or other equipment are currently deployed or are anticipated to be deployed. In some implementations, the borehole 110 can be a scout hole or a pilot hole, that is drilled prior to the drilling of a wellbore or drilled alongside a wellbore. For example, a scout hole can be used to evaluate the characteristics of the subterranean formation 114 prior to expending resources to construct a well at that location. As another example, a scout hole can be used to evaluate the characteristics of the subterranean formation 114 during the drilling, completion, and/or production stages of a well, before drilling multiple high angle and horizontal wells in the vicinity of the pilot hole.

Further, fluid, such as water based mud, can be circulated in the borehole 110. This can be beneficial, for example, in eliminating or otherwise reducing the presence of hydrocarbons in the borehole 110. In some implementations, fluid can be circulated prior to the insertion of the induced gas logging tool 102 in the borehole 110. In some implementations, fluid can be circulated subsequent to the insertion of the induced gas logging tool 102 in the borehole 110.

Figure 2A:
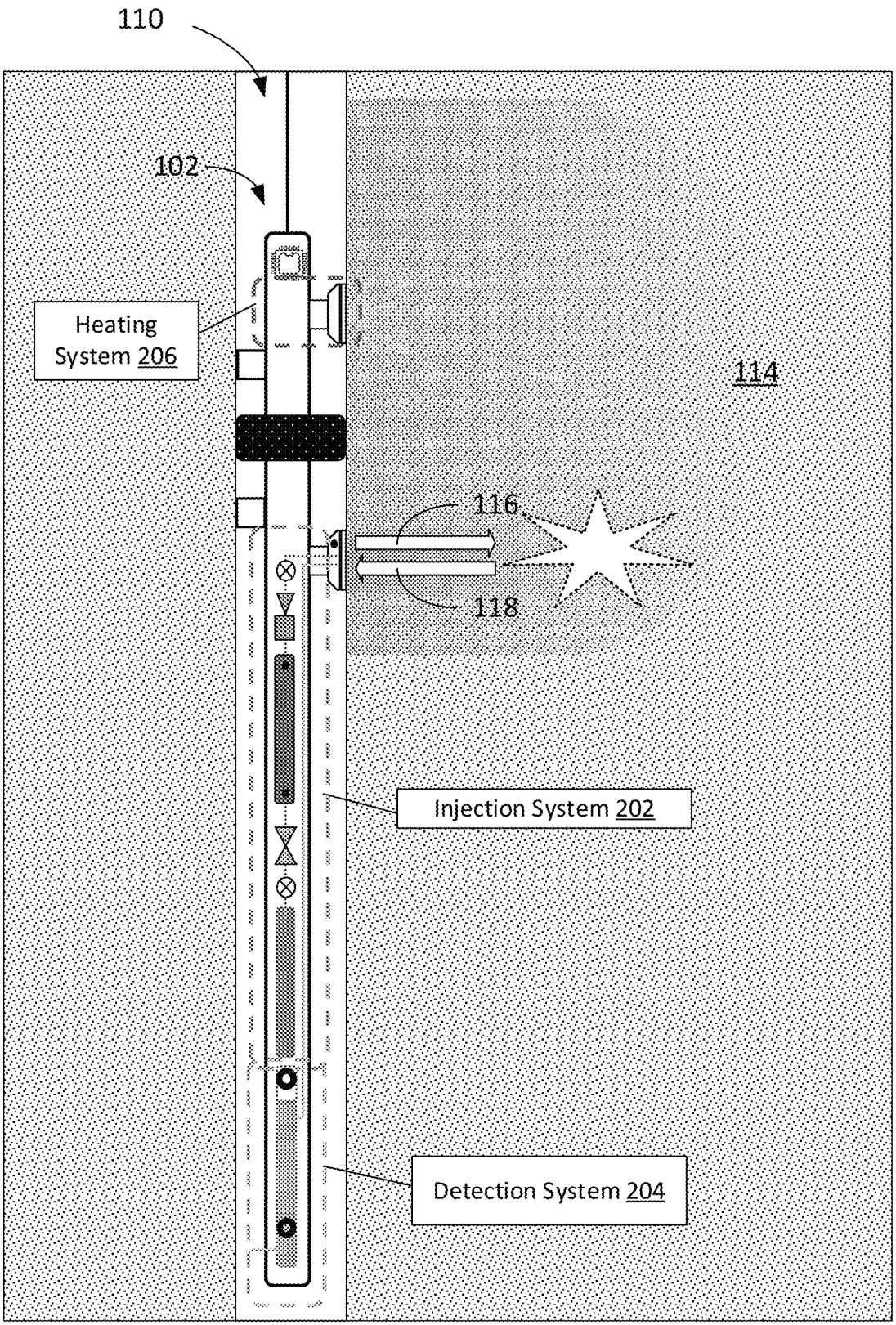
FIGS. 2A and 2B are diagrams of an example induced gas logging tool.

Once positioned, the induced gas logging tool 102 injects a reactive gas 116 into the subterranean formation 114 using an injection system 202 (for example, as shown in FIG. 2A). As an example, the reactive gas 116 can be composed, at least in part, of oxygen gas (for example, gaseous $O_2$). The reactive gas 116 chemically reacts with the contents of the subterranean formation 114 to produce one or more chemical products 118.

In some implementations, the reactive gas 116 can chemically react with one or more of hydrocarbons in the subterranean formation 114. Hydrocarbons are organic compounds that are composed mainly of hydrogen and carbon atoms, with impurities such as nitrogen, carbon dioxide, and hydrogen sulfide. Example hydrocarbons include methane, ethane, ethene (ethylene), ethyne (acetylene), propane, propene (propylene), propyne (methylacetylene), cyclopropane, propadiene (allene), butane, butene (butylene), butyne, cyclobutane, butadiene, pentane, pentene, pentyne, cyclopentane, pentadiene (piperylene), hexane, hexene, hexyne, cyclohexane, hexadiene, heptane, heptene, heptyne, cycloheptane, heptadiene, octane, octene, octyne, cyclooctane, octadiene, nonane, nonene, nonyne, cyclononane, nonadiene, decane, decene, decyne, cyclodecane, decadiene, undecane, undecballene, undecyne, cycloundecane, undecadiene, dodecane, dodecene, dodecyne, cyclododecane, and dodecadiene. The reactive gas 116 can chemically react with one or more hydrocarbons or other compositions to produce chemical products 118 such carbon dioxide gas (for example, gaseous CO2) and carbon monoxide gas (for example, gaseous CO).

In some implementations, the reactive gas 116 can chemically react with other substances in the subterranean formation 114. For example, the reactive gas 116 can chemically react with hydrogen sulfide gas (for example, gaseous $H_2S$) to produce chemical products 118 such sulfur dioxide gas (for example, gaseous $SO_2$). In some implementations, the presence of hydrogen sulfide gas can be an operational, health, safety, and/or environmental concern during well production.

Subsequent to and/or during the injection of the reactive gas 116, the induced gas logging tool 102 collects samples from the subterranean formation 114 using a detection system 204 (for example, as shown in FIG. 2A). In some implementation, samples can be collected from the same region of the subterranean formation 114 (or substantially the same region) into which the reactive gas 116 is injected. In some implementations, the samples can be entirely gaseous or substantially gaseous. In some implementations, the samples can include a combination of gas and liquid. In some implementations, the induced gas logging tool 102 can separate the gaseous components of the sample from the fluid components of the sample, and retain the gaseous components for further processing. Further, the induced gas logging tool 102 can test and subsequently discard the liquid components.

In some implementations, the induced gas logging tool 102 can also heat the subterranean formation 114 to facilitate chemical reactions between the reactive gas 116 and substances within the subterranean formation 114, such that the chemical products 118 of the chemical reactions can be more readily collected and measured. For example, as shown in FIG. 2A, the induced gas logging tool 102 can include a heating system 206 configured to heat the region of the subterranean formation 114 into which the reactive gas 116 is injected and/or from which the samples are collected. In some implementations, the heating system 206 can include one or more microwave magnetrons and/or electric induction heating elements configured to selectively heat particular regions of the subterranean formation 114.

In some implementations, the gas logging tool 102 can heat regions of the subterranean formation 114 to a temperature that is above an auto-ignition temperature of one or more hydrocarbons in the subterranean formation 114, such that the hydrocarbons ignite in the presence of the reactive gas 116. This can be beneficial, for example, in inducing the formation of gaseous chemical products in the subterranean formation, such as chemical products of a chemical reaction between the reactive gas 116 and hydrocarbons. In some implementation, this heating process can induce a "burn" within the subterranean formation 114 (for example, an ignition of the hydrocarbons in the presence of the reactive gas 116), and can produce a localized pocket of high pressure gas within the subterranean formation 114. This pressure of the pocket of gas may also be increased due to heat-induced gas expansion.

Figure 3A:
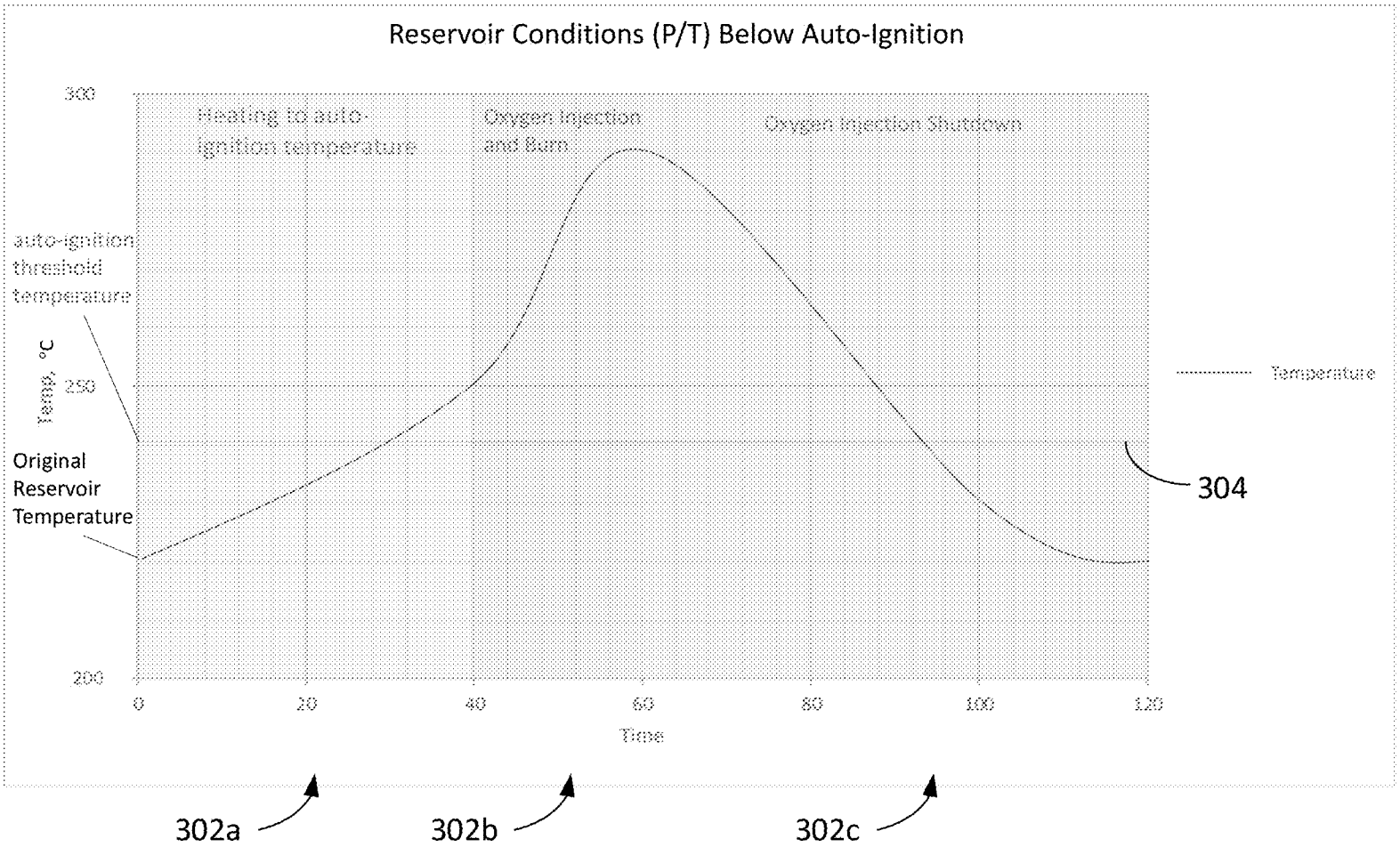
FIGS. 3A and 3B are diagrams of example phases for operating an induced gas logging tool.

In some implementations, the gas logging tool 102 can heat regions of subterranean formation 114 to a particular temperature prior to the injection of the reactive gas 116. For example, referring to FIG. 3A, the gas logging tool 102 can initially heat a region of the subterranean formation 114 during a first phase 302*a*. When the temperature of the region of the subterranean formation 114 is above a threshold temperature 304 (for example, the auto-ignition temperature of one or more hydrocarbons in the subterranean formation 114), the gas logging tool 102 can inject the reactive gas 116 into the subterranean formation 114 during a second phase 302*b* and induce a "burn" within the subterranean formation 114 (for example, an ignition of the hydrocarbons in the presence of the reactive gas 116). Subsequently, the gas logging tool 102 can discontinue the injection of the reactive gas 116 during a third phase 302*c*. The gas logging tool 102 can collect samples during the third phase 302*c*.

Figure 3B:
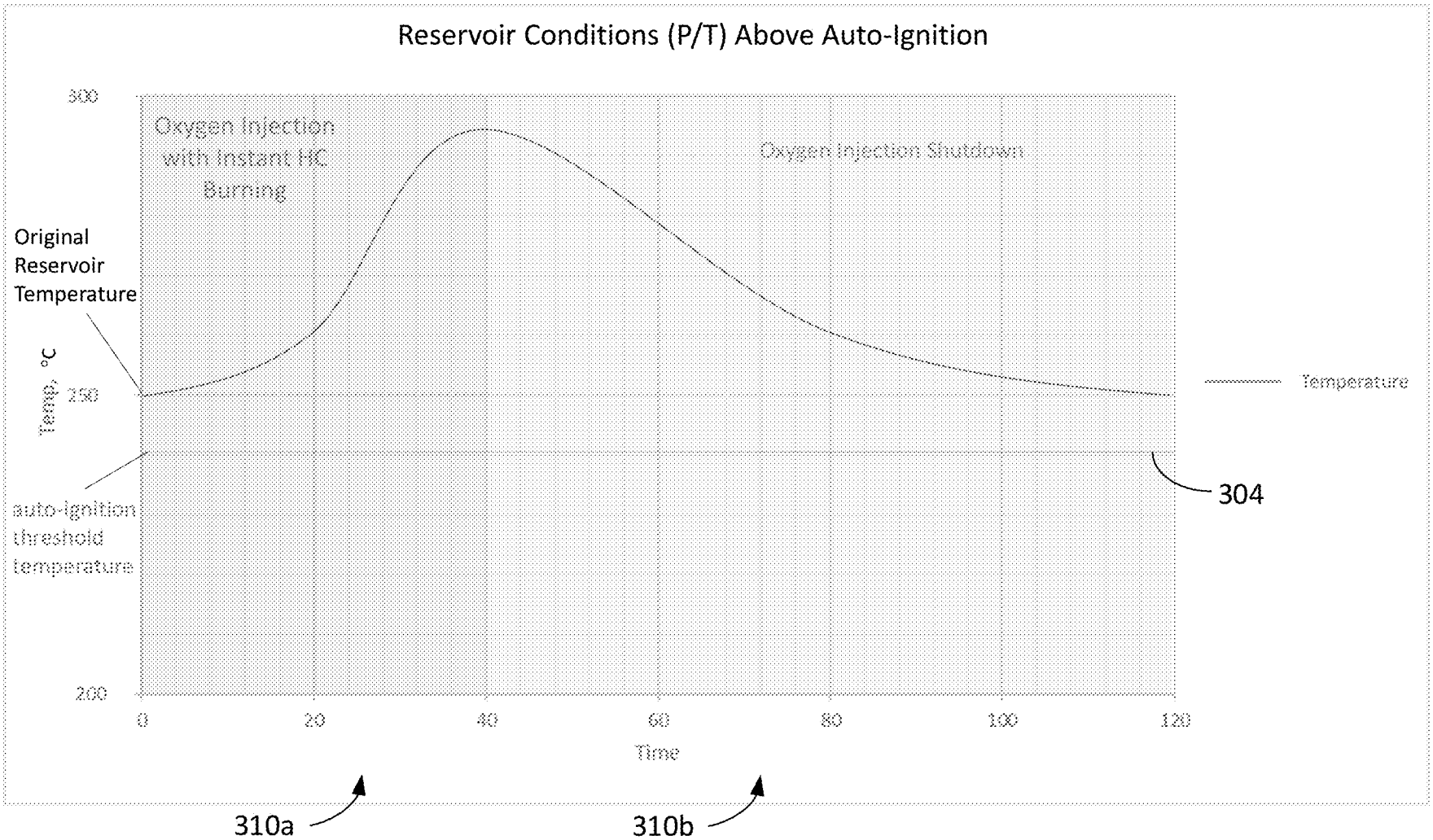

In some implementations, the gas logging tool 102 can refrain from heating regions of subterranean formation 114, such as when the temperature of the subterranean formation 114 is already above the auto-ignition temperature of one or more hydrocarbons in the subterranean formation 114. For example, referring to FIG. 3B, if the temperature of a region of the subterranean formation 114 is already above the threshold temperature 304 (for example, the auto-ignition temperature of one or more hydrocarbons in the subterranean formation 114), the gas logging tool 102 can inject the reactive gas 116 into the subterranean formation 114 during a first phase 310*a* and induce a burn within the subterranean formation 114. Subsequently, the gas logging tool 102 can discontinue the injection of the reactive gas 116 during a second phase 310*b*. The gas logging tool 102 can collect samples during the second phase 310*b*.

The induced gas logging tool 102 obtains one or more sensor measurements of the collected samples. As an example, the detection system 204 can detect the presence one or more gaseous substances in the collected samples, such as carbon dioxide gas, carbon monoxide gas, sulfur dioxide gas, and/or oxygen gas. As another example, the detection system 204 can measure the concentration of each of those substances in the collected samples. As another example, the detection system 204 can measure the chemical composition of each of the collected samples, such as the relative amounts of each of the constituent substances in each of the collected samples. As another example, the detection system 204 can measure the pressure of each of the collected samples. As another example, the detection system 204 can measure the temperature of each of the collected samples.

The system 100 can determine a composition of the subterranean formation 114 based on the measurements obtained by the detection system 204. For example, the induced gas logging tool 102 can transmit the measurements to the control and processing system 150 deployed on the computer system 106 (for example, via the network 108). The control and processing system 150 processes the measurements to determine the composition of the subterranean formation 114, and outputs an indication of the composition to one or more users (for example, using a graphical user interface presented on a display device). Further, the control and processing system 150 can store the measurements and data regarding the composition of the subterranean formation 114 for further retrieval and processing.

In some implementations, the control and processing system 150 can determine a presence of hydrocarbons in the subterranean formation 114 based on a determination that carbon dioxide gas and/or carbon monoxide gas (for example, products of a chemical reaction between oxygen gas and hydrocarbons) were present in the samples collected by the induced gas logging tool 102. Further, the control and processing system 150 can determine a presence of hydrogen sulfide in the subterranean formation 114 based on a determination that sulfur dioxide gas (for example, the product of a chemical reaction between oxygen gas and hydrogen sulfide) was present in the samples collected by the induced gas logging tool 102.

In some implementations, the control and processing system 150 can determine a concentration of hydrocarbons in the subterranean formation 114, relative to other substances in the subterranean formation 114. For example, if the measurements obtained by the induced gas logging tool 102 indicate that the concentrations of carbon dioxide gas and/or carbon monoxide gas in the collected samples are high, the control and processing system 150 can determine that the concentration of hydrocarbons in the subterranean formation 114 is also high. As another example, if the measurements obtained by the induced gas logging tool 102 indicate that the concentrations of carbon dioxide gas and/or carbon monoxide gas in the collected samples are low, the control and processing system 150 can determine that the concentration of hydrocarbons in the subterranean formation 114 is also low. In some implementations, the control and processing system 150 can determine a concentration of hydrocarbons in the subterranean formation 114 based on a proportional relationship between (i) the concentrations of carbon dioxide gas and/or carbon monoxide gas in the collected sample 118, and (ii) the concentration of hydrocarbons in the subterranean formation 114.

In some implementations, the control and processing system 150 can determine a concentration of hydrogen sulfide in the subterranean formation 114, relative to other substances in the subterranean formation 114. For example, if the measurements obtained by the induced gas logging tool 102 indicate that the concentration of sulfur dioxide gas in the collected samples are high, the control and processing system 150 can determine that the concentration of hydrogen sulfide in the subterranean formation 114 is also high. As another example, if the measurements obtained by the induced gas logging tool 102 indicate that the concentrations of sulfur dioxide gas in the collected samples 118 is low, the control and processing system 150 can determine that the concentration of hydrogen sulfide in the subterranean formation 114 is also low. In some implementations, the control and processing system 150 can determine a concentration of hydrogen sulfide in the subterranean formation 114 based on a proportional relationship between (i) the concentration of sulfur dioxide gas in the collected sample, and (ii) the concentration of hydrogen sulfide in the subterranean formation 114.

In some implementations, the control and processing system 150 can also determine a concentration of hydrocarbons and/or hydrogen sulfide in the subterranean formation 114, relative to other substances in the subterranean formation 114, based on a concentration of residual reactive gas 116 (for example, unburned $O_2$) present in the collected samples 118. A higher concentration of residual reactive gas 116 can indicate, for example, that the concentration of hydrocarbons and/or hydrogen sulfide in the subterranean formation 114 is low. A lower concentration or absence of residual reactive gas 116 can indicate, for example, that the concentration of hydrocarbons and/or hydrogen sulfide in the subterranean formation 114 is high.

Further, the analyses of residual oxygen gas and induced carbon dioxide gas and carbon monoxide gas can be integrated to provide a more accurate formation hydrocarbon evaluation. For example, low residual oxygen gas and high carbon dioxide gas may indicate that the concentration of carbon dioxide that was originally in the formation is high, and that the concentration of hydrocarbon in the formation is also high. As another example, high residual oxygen gas and high carbon dioxide gas may indicate that the concentration of carbon dioxide gas that was originally in the formation is high, and that the concentration of hydrocarbon in the formation is low. As another example, high residual oxygen gas and low carbon dioxide gas may indicate an absence or an otherwise low concentration of hydrocarbon in the formation. As another example, low residual oxygen gas and high carbon dioxide gas may indicate a combustion and burning of the hydrocarbon, and correspondingly, a presence and/or a high concentration of hydrocarbon in the formation.

Figure 2B:
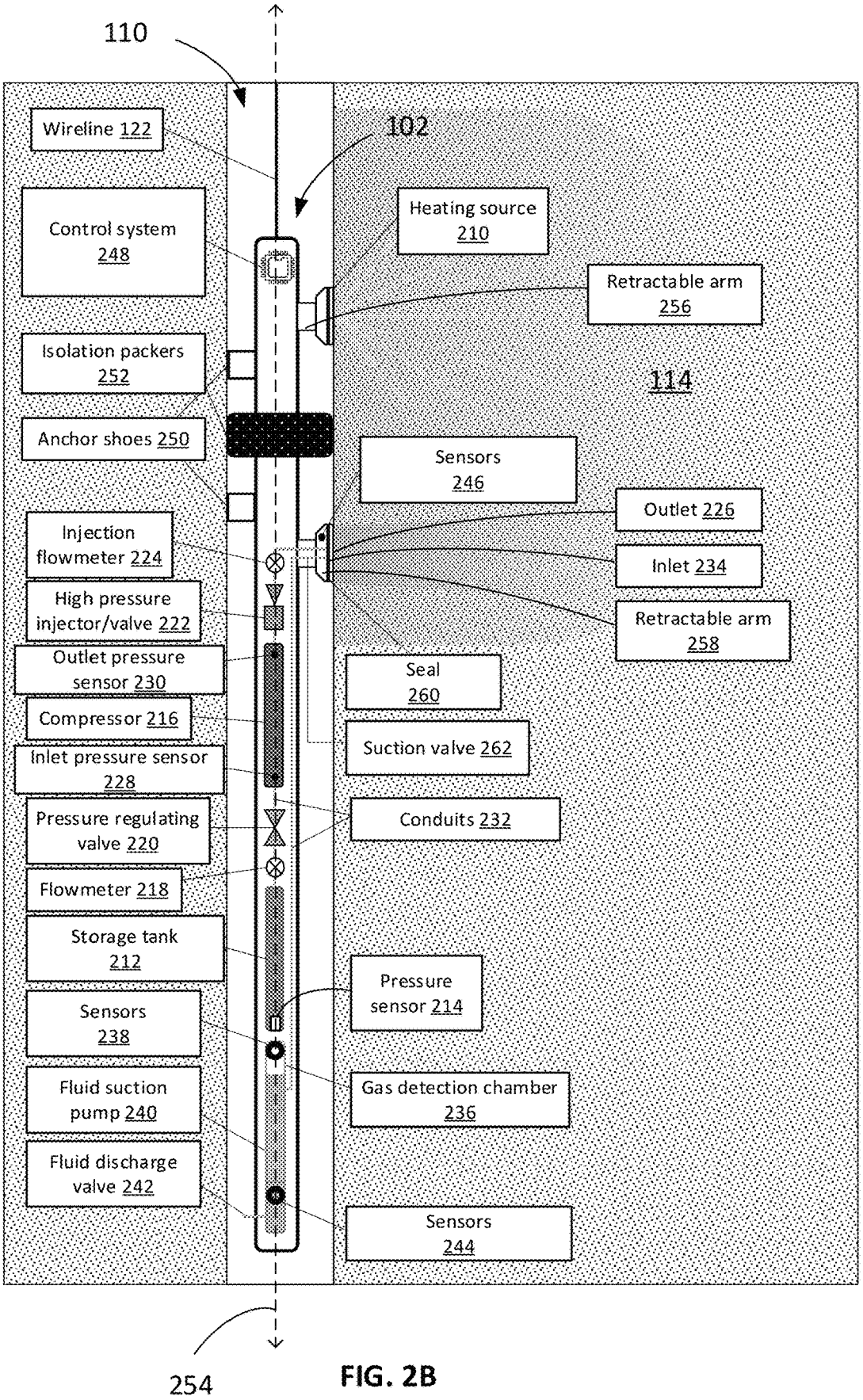

The induced gas logging tool 102 is shown in greater detail in FIGS. 2A and 2B.

As described above, the induced gas logging tool 102 can include a heating system 206 configured to heat the region of the subterranean formation 114 into which the reactive gas 116 is injected and/or from which the samples are collected. As shown in FIG. 2B, the heating system 206 can include one or more heating sources 210, such as one or more microwave magnetrons and/or electric induction heating elements. Further, the heating sources 210 can be disposed on a retractable arm 256 that enables the heating source 210 to be positioned closer to the walls of the borehole 110 (for example, when the induced gas logging tool 102 is conducting logging operations) and positioned away from the walls of the borehole 110 (for example, when the induced gas logging tool 102 is being moved within the borehole 110).

As described above, the induced gas logging tool 102 can also include an injection system 202 configured to inject a reactive gas 116 into the subterranean formation 114. As shown in FIG. 2B, the injection system 202 can include a storage tank 212 (for example, a cylinder or canister) for storing the reactive gas 116. The storage tank 212 can also include one or more pressure sensors 214 configured to measure a pressure within the storage tank 212 (for example, to determine the amount of the reactive gas 116 remaining in the storage tank 212).

The injection system 202 also includes a compressor 216 in fluid communication with the storage tank 212 via a flowmeter 218 and a pressure regulating valve 220. The pressure regulating valve 220 regulates a flow of the reactive gas 116 from the storage tank 212 to the compressor 216, and reactively provides quantities of the reactive gas 116 to the compressor 216. The flow of the reactive gas 116 is measured using the flowmeter 218. The compressor 216 compresses the reactive gas 116, and injects the reactive gas 116 into the subterranean formation via a high pressure injector and valve 222 (which regulates the flow of the reactive gas 116 out of the compressor 216), an injection flowmeter 224 (which measures the flow of the reactive gas 116), and an outlet 226 in fluid and/or gaseous communication with an exterior of the induced gas logging tool 102. As shown in FIG. 2B, the injection system 202 can also include an inlet pressure sensor 228 and an outlet pressure sensor 230 to measure the pressure of the reactive gas 116 input into and output from the compressor 216, respectively.

The reactive gas 116 can be conveyed between each of the components of the injection system 202 by one or more high pressure conduits 232, such as tubes, pipes, hollow cylinders, or other conduits for conveying gas and/or liquid.

As described above, the induced gas logging tool 102 can also include a detection system 204 configured to collect samples from the subterranean formation 114 and obtain measurements regarding the collected samples. As shown in FIG. 2B, the gas injection system includes an inlet 234 (for example, a conduit such as a tube, a pipe, hollow cylinder, or a pipe) that is in fluid and/or gaseous communication with the exterior of the injection system 202 on one end, and in fluid and/or gaseous communication with a gas detection chamber 236 on its opposite end. When a suction valve 262 positioned along the inlet 234 is opened and a fluid suctions pump 240 positioned in the gas detection chamber 236 is activated, samples from the subterranean formation 114 are drawn into the gas detection chamber 236 through the inlet 234.

The gas detection chamber 236 is a hollow chamber for receive the samples from the subterranean formation 118. One or more sensors 238 are positioned within the gas detection chamber 236. Further, the fluid suction pump 240 and a fluid discharge valve 242 are coupled to the gas detection chamber 236. The inlet 234 is coupled between (i) the gas detection chamber 236 and (ii) the fluid suction pump 240 and the fluid discharge valve 242. When the induced gas logging tool 102 is positioned vertically (for example, as shown in FIG. 2B) and the fluid suction pump 240 is activated, liquid components of samples entering the gas detection chamber 236 (for example, water and mud filtrate) flow to the bottom of the gas detection chamber 236 towards the fluid suction pump 240 and the fluid discharge valve 242, and are discharged out of the gas detection chamber 236 and out of the induced gas logging tool 102. As shown in FIG. 2B, the outlet of fluid discharge valve 242 can be positioned away from the exterior-facing ends of the outlet 226 and/or the inlet 234, such that the expelled liquid does not interfere with the injection of the reactive gas 116 and/or the collection of samples 118.

Gaseous components of the samples remain within the gas detection chamber 236, and are measured using the sensors 238. As described above, the sensors 238 can measure properties of the samples 118, such as the presence and/or concentration of particular substances in samples obtained or collected by the induced gas logging tool 102 (for example, carbon dioxide gas, carbon monoxide gas, sulfur dioxide gas, oxygen gas, and/or sulfur dioxide gas), the chemical compositions of the collected samples 118, the pressures of the collected samples, and/or the temperatures of the collected samples 118.

The samples can be conveyed between each of the components of the detection system 204 by one or more high pressure conduits, such as tubes, pipes, hollow cylinders, or other conduits for conveying gas and/or liquid.

As shown in FIG. 2B, the detection system 204 can also include one or sensors 244 configured to measure properties of the liquid in the collected samples. As an example, the sensors 244 can include pH sensors configured to measure the acidity of the liquid. This can be beneficial, for example, as carbon monoxide and sulfur dioxide can dissolve in water to form carbonic acid and sulfuric acid. Accordingly, measurements of the pH of the liquid can be used as a quality control for the outlet of the gas sensors 238. Further, as the amount of fluid that is collected from the subterranean formation may be small, any acids formed within the samples can be diluted quickly once the fluid is discharged into the borehole 110. Accordingly, the effect of these acids to the borehole 110 and the equipment in the borehole 110 may be minimal.

As shown in FIG. 2B, the detection system 204 can also include one or sensors 246 configured to measure properties of the subterranean formation 114 in the region into which the reactive gas 116 is injected and/or from which the samples are collected. As an example, the sensors 246 can measure the temperature and/or the pressure of the subterranean formation 114 in that region.

As shown in FIG. 2B, components of the detection system 204 (for example, the outlet 226, the inlet 234, and/or the sensors 246) can be disposed on a retractable arm 258 that enables the components to be positioned closer to the walls of the borehole 110 (for example, when the induced gas logging tool 102 is conducting logging operations) and positioned away from the walls of the borehole 110 (for example, when the induced gas logging tool 102 is being moved within the borehole 110). Further, the retractable arm 258 can include a seal 260 (for example, a hollow circular seal) that encircles the exterior-facing ends of the outlet 226 and/or the inlet 234. When the retractable arm 258 is extended, the seal 260 can press against the walls of the borehole 110. In this position, the seal 260 encloses the outlet 226 and/or the inlet 234 against the walls of the borehole 110, such that the reactive gas 116 that is output from the outlet 226 is injected into the subterranean formation 114 (rather than into the borehole 110), and samples collected 118 by the inlet 234 are collected from the subterranean formation 114 (rather than from the borehole 110).

In some implementations, after the induced gas logging tool 102 has performed measurements on the collect samples, the induced gas logging tool 102 can vacuum the samples from the gas detection chamber 236 (for example, using the fluid suction pump 240, and close the suction valve 262. The suction valve 262 can be reopened during one or more future intervals to collect further samples from the subterranean formation 114.

As shown in FIG. 2B, the induced gas logging tool 102 can include a control system 248 configured to control the operation of the induced gas logging tool 102. As an example, the control system 248 can be communicatively coupled to the network 108. Further, the control system 248 configured to receive commands from the control and processing system 150, and operate the heating system 206, the injection system 202, the detection system 204, and/or any other component of the induced gas logging tool 102 in accordance with those commands. As another example, the control system 248 can be configured to transmit data to the control and processing system 150, such as sensor data collected by the induced gas logging tool 102, diagnostic information regarding the operational status and condition of the induced gas logging tool 102, and/or any other data generated by the induced gas logging tool 102.

As shown in FIG. 2B, the wireline 122 can be secured to an end of the induced gas logging tool 102. When the induced gas logging tool 102 is suspended by the wireline 122, the induced gas logging tool 102 is oriented vertically under the force of gravity (for example, such that a longitudinal axis 254 of the induced gas logging tool 102 is vertical).

Further, the induced gas logging tool 102 can include one or more structures to align the induced gas logging tool 102 within the borehole 110. For example, as shown in FIG. 2B, the induced gas logging tool 102 can include one or more anchor shoes 250 protruding from an exterior periphery of the induced gas logging tool 102. The anchor shoes are shaped and dimensioned to space the induced gas logging tool 102 from the walls of the borehole 110, such that the induced gas logging tool 102 is aligned along a central portion of the borehole 110 (for example, a central axis extending through the borehole 110).

As another example, as shown in FIG. 2B, the induced gas logging tool 102 can include one or more isolation packers 252 configured to isolate borehole fluids around the injection system 202 from the heating source 210. For example, the isolation packers 252 can form a seal with the walls of the borehole 110, such that fluids proximate to the injection system 202 cannot flow into a vicinity of the heating source 210 within the borehole 110. This can be beneficial, for example, in preventing or otherwise reducing the likelihood that fluids and/or gases are ignited by the heating source 210 within the borehole 110. As shown in FIG. 2B, in some implementations, an isolation packer 252 can be positioned between two anchors shoes 250 with respect to the longitudinal axis 254 of the injection system 202.

Figure 4:
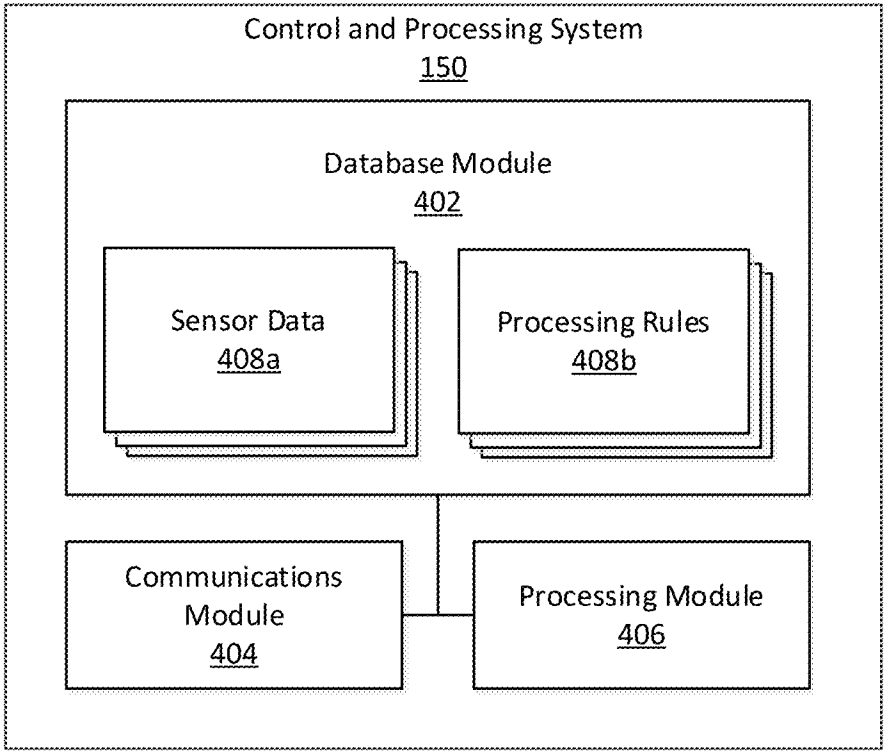
FIG. 4 is a diagram of an example control and processing system for controlling and operation of an induced gas logging tool.

FIG. 4 shows various aspects of the control and processing system 150. The control and processing system 150 includes several modules that perform particular functions related to the operation of the system 100. For example, the control and processing system 150 can include a database module 402, a communications module 404, and a processing module 406.

The database module 402 maintains information related to operating the system 100 to evaluate a subterranean formations. As an example, the database module 402 can store sensor data 408*a* including measurements obtained by the detection system 204. For instance, as described with reference to FIGS. 1, 2A, and 2B, the sensor data 408*a* can include measurements such as the presence and/or concentration of particular substances in samples obtained or collected by the induced gas logging tool 102 (for example, carbon dioxide gas, carbon monoxide gas, sulfur dioxide gas, oxygen gas, and/or sulfur dioxide gas), the chemical compositions of the collected samples, the pressures of the collected samples, and/or the temperatures of the collected samples.

Further, the database module 402 can store processing rules 408*b* specifying how data in the database module 402 can be processed to determine characteristics of a subterranean formation. For instance, as described with reference to FIGS. 1, 2A, and 2B, the processing rules 408*b* can specify processes for determine the composition of the subterranean formation 114 based on the sensor data 408*a* obtained by the detection system 204.

As another example, the processing rules 408*b* can specify relationships, functions, formulas, and/or algorithms for determining a presence of hydrocarbons in the subterranean formation 114 based on a determination that residual oxygen gas, carbon dioxide gas and/or carbon monoxide gas were present in the samples collected by the induced gas logging tool 102.

As another example, the processing rules 408*b* can specify relationships, functions, formulas, and/or algorithms for determining a presence of hydrogen sulfide in the subterranean formation 114 based on a determination that sulfur dioxide gas was present in the samples collected by the induced gas logging tool 102.

As another example, the processing rules 408*b* can specify relationships, functions, formulas, and/or algorithms for determining a concentration of hydrocarbons in the subterranean formation 114, relative to other substances in the subterranean formation 114, based on the samples collected by the induced gas logging tool 102.

As another example, the processing rules 408*b* can specify relationships, functions, formulas, and/or algorithms for determining a concentration of hydrogen sulfide in the subterranean formation 114, relative to other substances in the subterranean formation 114, based on the samples collected by the induced gas logging tool 102.

As described above, the control and processing system 150 also includes a communications module 404. The communications module 404 allows for the transmission of data to and from the control and processing system 150. For example, the communications module 404 can be communicatively connected to the network 108, such that it can transmit data to and receive data from the induced gas logging tool 102. Information received from the induced gas logging tool 102 can be processed (for example, using the processing module 406) and stored (for example, using the database module 402).

As described above, the control and processing system 150 also includes a processing module 406. The processing module 406 processes data stored or otherwise accessible to the control and processing system 150. For instance, the processing module 406 can determine characteristics of a subterranean formation based on the sensor data 408*a* and the processing rules 408*c* (for example, as described above). Further, the processing module 406 can generate one or more graphical user interfaces to present information to the user.

Further still, the processing module 406 can generate commands to control the operation of the other components of the system 100. For example, the processing module 406 can generate commands to the deployment structure 104 to adjust the position of the induced gas logging tool 102 within the borehole 110. As another example, the processing module 406 can generate commands to the gas logging tool 102 to heat the subterranean formation 114, inject the reactive gas 116 into the subterranean formation 114, collect samples of the chemical products 118 from the subterranean formation 114, and/or perform measurements of the collected samples. These commands can be transmitted to the deployment structure 104 and/or the induced gas logging tool 102, for example, using the communications module 404.

Example Processes

Figure 5:
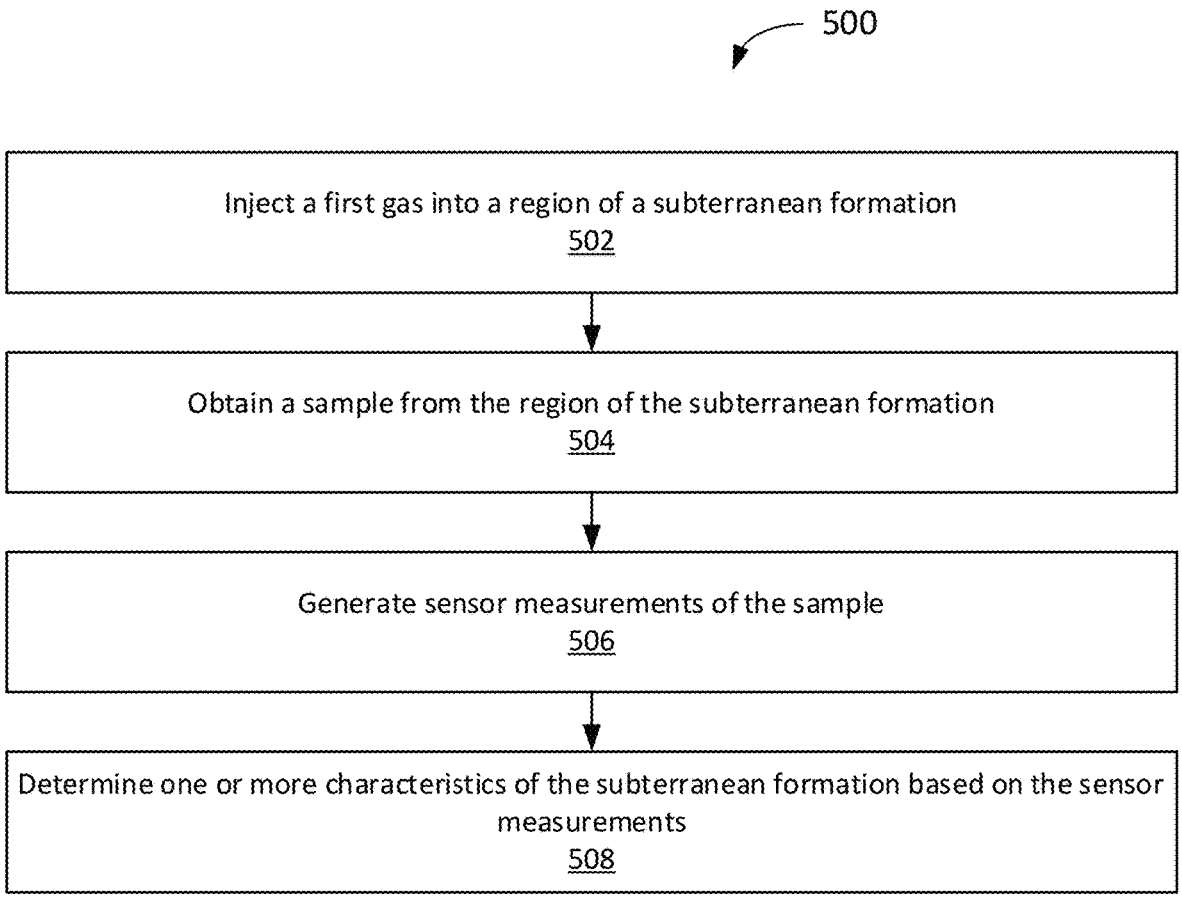
FIG. 5 is a flow chart diagram of an example process for evaluating a subterranean formation using an induced gas logging tool.

An example process 500 for evaluating a subterranean formation using an induced gas logging tool is shown in FIG. 5. In some implementations, the process 500 can be performed by the systems described in this disclosure (for example, the system 100, the induced gas logging tool 102, and/or the control and processing system 150 shown and described with respect to FIGS. 1, 2A, 3A, and 4) using one or more processors (for example, using the processor or processors 610 shown in FIG. 6).

In the process 500, a first gas is injected into a region of a subterranean formation (block 502). In some implementations, the first gas can include a chemically reactive gas, such as an oxygen gas. As an example, an oxygen gas can be injected using the injection system 202 of an induced gas logging tool 102, as described with reference to FIGS. 1, 2A, and 2B.

Subsequent to the injection the first gas into the region of the subterranean formation, a sample is obtained from the region of the subterranean formation (block 504). As an example, a sample can be obtained using the detection system 204 of the induced gas logging tool 102, as described with reference to FIGS. 1, 2A, and 2B.

Sensor measurements of the sample are generated (block 506). As an example, a sensor measurements can be generated using the detection system 204 of the induced gas logging tool 102, as described with reference to FIGS. 1, 2A, and 2B.

In some implementations, the sensor measurements can indicate a concentration of each of several second gases in the sample. The second gases can include carbon dioxide gas, carbon monoxide gas, oxygen gas, and/or sulfur dioxide gas.

Further, one or more characteristics of the subterranean formation are determined based on the sensor measurements (block 508). As an example, the control and processing system 150 can determine characteristics of the subterranean formation based on the sensor measurements generated by the detection system 204, as described with reference to FIGS. 1, 2A, and 2B.

In some implementations, determining one or more characteristics of the subterranean formation can include determining a presence of one or more hydrocarbons in the subterranean formation based on the sensor measurements.

In some implementations, the process 500 can also include heating the region of the subterranean formation, for example, prior to injecting the first gas into the region of a subterranean formation. As an example, the region of the subterranean formation can be heated using the heating system 206 of the induced gas logging tool 102, as described with reference to FIGS. 1, 2A, 2B, and 3A.

In some implementations, the region of the subterranean formation can be heated above a first temperature. The first temperature can be an auto-ignition temperature of one or more hydrocarbons in the region of the subterranean formation.

Example Systems

Some implementations of the subject matter and operations described in this specification can be implemented in digital electronic circuitry, or in computer software, firmware, or hardware, including the structures disclosed in this specification and their structural equivalents, or in combinations of one or more of them. For example, in some implementations, one or more components of the system 100 and control and processing system 150 can be implemented using digital electronic circuitry, or in computer software, firmware, or hardware, or in combinations of one or more of them. In another example, the process 500 shown in FIG. 5 can be implemented using digital electronic circuitry, or in computer software, firmware, or hardware, or in combinations of one or more of them.

Some implementations described in this specification can be implemented as one or more groups or modules of digital electronic circuitry, computer software, firmware, or hardware, or in combinations of one or more of them. Although different modules can be used, each module need not be distinct, and multiple modules can be implemented on the same digital electronic circuitry, computer software, firmware, or hardware, or combination thereof.

Some implementations described in this specification can be implemented as one or more computer programs, that is, one or more modules of computer program instructions, encoded on computer storage medium for execution by, or to control the operation of, data processing apparatus. A computer storage medium can be, or can be included in, a computer-readable storage device, a computer-readable storage substrate, a random or serial access memory array or device, or a combination of one or more of them. Moreover, while a computer storage medium is not a propagated signal, a computer storage medium can be a source or destination of computer program instructions encoded in an artificially generated propagated signal. The computer storage medium can also be, or be included in, one or more separate physical components or media (for example, multiple CDs, disks, or other storage devices).

The term "data processing apparatus" encompasses all kinds of apparatus, devices, and machines for processing data, including by way of example a programmable processor, a computer, a system on a chip, or multiple ones, or combinations, of the foregoing. The apparatus can include special purpose logic circuitry, for example, an FPGA (field programmable gate array) or an ASIC (application specific integrated circuit). The apparatus can also include, in addition to hardware, code that creates an execution environment for the computer program in question, for example, code that constitutes processor firmware, a protocol stack, a database management system, an operating system, a cross-platform runtime environment, a virtual machine, or a combination of one or more of them. The apparatus and execution environment can realize various different computing model infrastructures, such as web services, distributed computing and grid computing infrastructures.

A computer program (also known as a program, software, software application, script, or code) can be written in any form of programming language, including compiled or interpreted languages, declarative or procedural languages. A computer program may, but need not, correspond to a file in a file system. A program can be stored in a portion of a file that holds other programs or data (for example, one or more scripts stored in a markup language document), in a single file dedicated to the program in question, or in multiple coordinated files (for example, files that store one or more modules, sub programs, or portions of code). A computer program can be deployed to be executed on one computer or on multiple computers that are located at one site or distributed across multiple sites and interconnected by a communication network.

Some of the processes and logic flows described in this specification can be performed by one or more programmable processors executing one or more computer programs to perform actions by operating on input data and generating output. The processes and logic flows can also be performed by, and apparatus can also be implemented as, special purpose logic circuitry, for example, an FPGA (field programmable gate array) or an ASIC (application specific integrated circuit).

Processors suitable for the execution of a computer program include, by way of example, both general and special purpose microprocessors, and processors of any kind of digital computer. Generally, a processor will receive instructions and data from a read only memory or a random access memory or both. A computer includes a processor for performing actions in accordance with instructions and one or more memory devices for storing instructions and data. A computer can also include, or be operatively coupled to receive data from or transfer data to, or both, one or more mass storage devices for storing data, for example, magnetic, magneto optical disks, or optical disks. However, a computer need not have such devices. Devices suitable for storing computer program instructions and data include all forms of non-volatile memory, media and memory devices, including by way of example semiconductor memory devices (for example, EPROM, EEPROM, AND flash memory devices), magnetic disks (for example, internal hard disks, and removable disks), magneto optical disks, and CD-ROM and DVD-ROM disks. The processor and the memory can be supplemented by, or incorporated in, special purpose logic circuitry.

To provide for interaction with a user, operations can be implemented on a computer having a display device (for example, a monitor, or another type of display device) for displaying information to the user. The computer can also include a keyboard and a pointing device (for example, a mouse, a trackball, a tablet, a touch sensitive screen, or another type of pointing device) by which the user can provide input to the computer. Other kinds of devices can be used to provide for interaction with a user as well. For example, feedback provided to the user can be any form of sensory feedback, such as visual feedback, auditory feedback, or tactile feedback. Input from the user can be received in any form, including acoustic, speech, or tactile input. In addition, a computer can interact with a user by sending documents to and receiving documents from a device that is used by the user. For example, a computer can send webpages to a web browser on a user's client device in response to requests received from the web browser.

A computer system can include a single computing device, or multiple computers that operate in proximity or generally remote from each other and typically interact through a communication network. Examples of communication networks include a local area network ("LAN") and a wide area network ("WAN"), an inter-network (for example, the Internet), a network including a satellite link, and peer-to-peer networks (for example, ad hoc peer-to-peer networks). A relationship of client and server can arise by virtue of computer programs running on the respective computers and having a client-server relationship to each other.

Figure 6:
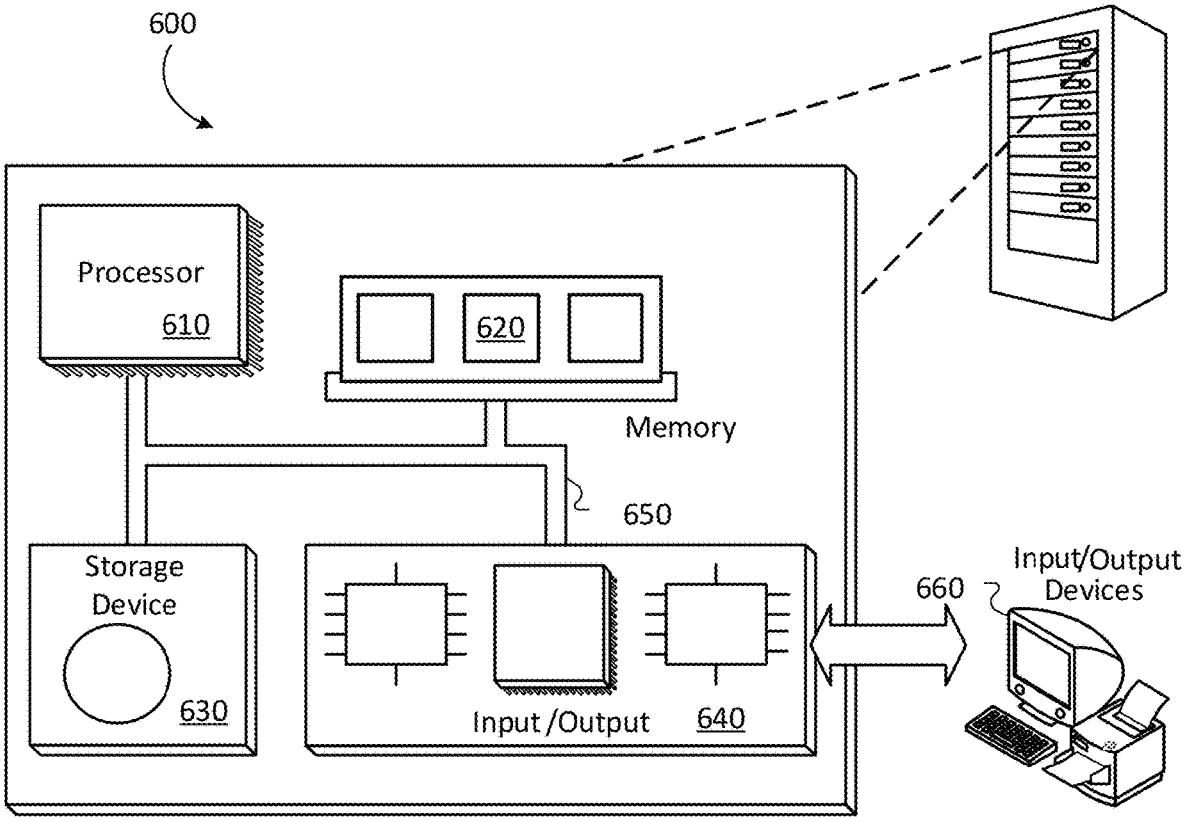
FIG. 6 is a schematic diagram of an example computer system.

FIG. 6 shows an example computer system 600 that includes a processor 610, a memory 620, a storage device 630 and an input/output device 640. Each of the components 610, 620, 630 and 640 can be interconnected, for example, by a system bus 650. The processor 610 is capable of processing instructions for execution within the system 600. In some implementations, the processor 610 is a single-threaded processor, a multi-threaded processor, or another type of processor. The processor 610 is capable of processing instructions stored in the memory 620 or on the storage device 630. The memory 620 and the storage device 630 can store information within the system 600.

The input/output device 640 provides input/output operations for the system 600. In some implementations, the input/output device 640 can include one or more of a network interface device, for example, an Ethernet card, a serial communication device, for example, an RS-232 port, or a wireless interface device, for example, an 802.11 card, a 3G wireless modem, a 4G wireless modem, or a 5G wireless modem, or both. In some implementations, the input/output device can include driver devices configured to receive input data and send output data to other input/output devices, for example, keyboard, printer and display devices 660. In some implementations, mobile computing devices, mobile communication devices, and other devices can be used.

While this specification contains many details, these should not be construed as limitations on the scope of what may be claimed, but rather as descriptions of features specific to particular examples. Certain features that are described in this specification in the context of separate implementations can also be combined. Conversely, various features that are described in the context of a single implementation can also be implemented in multiple embodiments separately or in any suitable sub-combination.

A number of embodiments have been described. Nevertheless, various modifications can be made without departing from the spirit and scope of the invention. Accordingly, other embodiments are within the scope of the claims.

What is claimed is:

1. A logging tool comprising:

a heating system comprising one or more heat sources, wherein the heating system is configured to heat a region of a subterranean formation above a first temperature, wherein the first temperature is an auto-ignition temperature of one or more hydrocarbons in the region of the subterranean formation;

an injection system comprising a gas source, wherein the injection system is configured to inject a first gas from the gas source into the region of the subterranean formation while the region of the subterranean formation is above the first temperature;

a detection system comprising a gas detection chamber and one or more sensors disposed in the gas detection chamber, wherein the detection system is configured to:

receive, in the gas detection chamber, a sample from the region of the subterranean formation, and generate, using the one or more sensors, sensor measurements of the sample; and an electronic control and processing system comprising one or more processors, wherein the electronic control and processing system is configured to determine one or more characteristics of the subterranean formation based on the sensor measurements.

2. The logging tool of claim 1, wherein the electronic control and processing system is configured to determine a presence of one or more hydrocarbons in the subterranean formation based on the sensor measurements.

3. The logging tool of claim 1, wherein the first gas comprises a chemically reactive gas.

4. The logging tool of claim 1, wherein the first gas comprises oxygen gas.

5. The logging tool of claim 1, wherein the sensor measurements indicate a concentration of each of a plurality of second gases in the sample.

6. The logging tool of claim 5, wherein the second gases comprise at least one of carbon dioxide gas, carbon monoxide gas, oxygen gas, or sulfur dioxide gas.

7. The logging tool of claim 1, wherein the one or more sensors comprise at least one of:

a carbon dioxide sensor, a carbon monoxide sensor, an oxygen sensor, a sulfur dioxide sensor, a temperature sensor, or a pressure sensor.

8. The logging tool of claim 1, wherein the heating source comprises at least one of a microwave magnetron or an electric induction heating element.

9. The logging tool of claim 1, wherein the detection system further comprises a pump configured to pump liquid within the gas detection chamber to an exterior of the logging tool.

10. The logging tool of claim 1, wherein the detection system further comprises a tube configured to convey the sample from an exterior of the logging tool to the gas detection chamber, wherein a first end of the tube is coupled to the exterior of the logging tool, and wherein a second end of the tube is coupled at a location between (i) the gas detection chamber and (ii) the pump.

11. The logging tool of claim 1, further comprising:

a wireline configured to suspend the logging tool within a borehole extending through the subterranean formation.

12. The logging tool of claim 11, further comprising:

an anchor shoe projecting from a periphery of the logging tool, wherein the anchor shoe is configured to align the logging tool along a central portion of the borehole.

13. The logging tool of claim 12, further comprising:

an isolation packer configured to form a seal with a wall of the borehole.

14. The logging tool of claim 1, wherein the logging tool is positioned on a drilling bottom hole assembly of a drilling system.

15. A method comprising:

heating a region of a subterranean formation above a first temperature, wherein the first temperature is an autoignition temperature of one or more hydrocarbons in the region of the subterranean formation;

subsequent to heating the region of the subterranean formation above the first temperature, injecting a first gas into the region of the subterranean formation;

subsequent to injecting the first gas into the region of the subterranean formation, obtaining a sample from the region of the subterranean formation;

generating sensor measurements of the sample; and determining one or more characteristics of the subterranean formation based on the sensor measurements.

16. The method of claim 15, wherein determining one or more characteristics of the subterranean formation comprises determining a presence of one or more hydrocarbons in the subterranean formation based on the sensor measurements.

17. The method of claim 15, wherein the first gas comprises a chemically reactive gas.

18. The method of claim 15, wherein the first gas comprises oxygen gas.

19. The method of claim 15, wherein the sensor measurements indicate a concentration of each of a plurality of second gases in the sample.

20. The method of claim 19, wherein the second gases comprise at least one of carbon dioxide gas, carbon monoxide gas, oxygen gas, or sulfur dioxide gas.

* * * * *